US010175011B2

(12) United States Patent
Walker

(10) Patent No.: US 10,175,011 B2
(45) Date of Patent: Jan. 8, 2019

(54) AIR CONDITIONING COIL CLEANING SYSTEM

(71) Applicant: John W. Walker, Parrish, FL (US)

(72) Inventor: John W. Walker, Parrish, FL (US)

( * ) Notice: Subject to any disclaimer, the term of this patent is extended or adjusted under 35 U.S.C. 154(b) by 210 days.

(21) Appl. No.: 14/213,547

(22) Filed: Mar. 14, 2014

(65) Prior Publication Data

US 2014/0352920 A1 Dec. 4, 2014

Related U.S. Application Data

(60) Provisional application No. 61/784,642, filed on Mar. 14, 2013.

(51) Int. Cl.

| | |
|---|---|
| ***F28G 15/04*** | (2006.01) |
| ***B08B 3/02*** | (2006.01) |
| ***F28G 1/16*** | (2006.01) |
| ***F28G 15/02*** | (2006.01) |

(52) U.S. Cl.

CPC ..... *F28G 15/04* (2013.01); *B08B 3/026* (2013.01); *F28G 1/16* (2013.01); *F28G 15/02* (2013.01)

(58) Field of Classification Search

CPC .... A01C 23/001; A01C 23/00; A01M 7/0085; B05B 7/0093; B05B 9/007

USPC ..... 239/146–176

See application file for complete search history.

(56) References Cited

U.S. PATENT DOCUMENTS

| | | | | |
|---|---|---|---|---|
| 3,680,786 | A | 8/1972 | Levy | |
| 4,284,127 | A * | 8/1981 | Collier | A47L 11/34 134/107 |
| 4,865,255 | A | 9/1989 | Luvisotto | |
| 4,934,017 | A * | 6/1990 | Kent | A47L 5/365 15/321 |
| 4,967,960 | A | 11/1990 | Futrell | |
| 5,311,892 | A | 5/1994 | Adelt et al. | |
| 5,331,985 | A | 7/1994 | Lyons | |
| 5,421,900 | A | 6/1995 | Clontz | |
| 6,062,486 | A | 5/2000 | Hill | |
| 6,070,808 | A | 6/2000 | Kildow | |
| 6,279,838 | B1 | 8/2001 | Sivells et al. | |
| 7,455,246 | B2 * | 11/2008 | Roth | B08B 3/026 222/609 |
| 7,841,351 | B1 * | 11/2010 | Kane | A01M 7/0046 134/172 |
| 8,034,189 | B2 * | 10/2011 | Munch | A61L 2/18 134/22.12 |
| 2001/0022323 | A1 * | 9/2001 | Aslakson | B08B 3/026 239/148 |
| 2007/0120366 | A1 * | 5/2007 | Grant | F02B 63/04 290/1 A |
| 2012/0125364 | A1 * | 5/2012 | Wiley | B08B 9/0936 134/10 |

FOREIGN PATENT DOCUMENTS

| | | |
|---|---|---|
| GB | 2461731 | 1/2010 |

* cited by examiner

*Primary Examiner* — Chee-Chong Lee

(74) *Attorney, Agent, or Firm* — Merchant & Gould P.C.

(57) ABSTRACT

A portable self-contained cooling coil cleaning system includes a cart with a first shelf and a second shelf and at least four rolling elements supporting the cart. A self-contained electrical power unit powers a pump. The pump is in fluid communication with a cleaning fluid reservoir and delivers cleaning fluid through a flow regulator, an extended length of hose and through a spray wand.

8 Claims, 7 Drawing Sheets

AIR CONDITIONING COIL CLEANING SYSTEM

BACKGROUND OF THE INVENTION

Field of the Invention

The present invention relates to a self-contained, portable coil cleaning system used for cleaning air conditioning or cooling coils.

Description of the Prior Art

Portable cleaning systems are well known for spraying detergents or water onto objects air cleaning. Moreover, relatively low pressure systems are known that are used for cleaning air conditioning coils. The systems typically include a pump powered by an AC power source or engine and include a spray pump and nozzle. A valve may be available for pumping fluid from a detergent tank. Cooling coils require cleaning to remove dirt and other materials that adversely affect cooling efficiency. Cooling coils typically utilize cooling fins that may be easily damaged with conventional high pressure washers.

Although portable systems are known, such systems have a limited battery life and may not have sufficient pressure and/or capacity to clean the large coil installations or multiple coil arrangements at a location. Moreover, the pressure control may not be adequate to provide sufficient pressure to clean the coils while limiting the pressure so that the coils are not dented or otherwise damaged. Moreover, although portable systems are known, the systems do not provide a self-contained system that addresses all of the needs associated with cleaning air conditioning or cooling coils. Such a system should include a power inverter to provide a portable power source for hand held power tools and other equipment used for cleaning operations or associated tasks. Moreover, the systems should provide sufficient controls to provide a detergent at the proper flow, pressure and spray pattern. As such systems may be need to transported to remote locations wherein a ready power supply may not be available or must access cooling systems where a cart or dolly cannot be moved close by, it is also necessary to include not just a wand but an extended length of hose for accessing the coils from the cart. In addition, the other maintenance may need to be performed along with the cleaning operations and it would be helpful to include hand held tools that may be stored and transported with the cleaning system. These tools may also need to be recharged or powered.

It can be seen that a portable system is required that provides sufficient power and control for providing sufficient controlled pressure for cleaning coils without damaging the coils. Moreover, such a system should provide its own power supply and include a power inverter for providing power to the system including the pump and any hand held power tools. A sufficient wand and length of hose should also be provided so that remote cooling units may be accessed so difficult to reach places within each cooling unit may be thoroughly cleaned. The cart should provide proper storage for all of the various systems required and be easily portable and moved by a single worker.

The present invention addresses these problems as well as others associated with portable cleaning systems cooling coils.

SUMMARY OF THE INVENTION

The present invention relates to a self-contained portable cooling coil cleaning system. The system is generally mounted on a four wheel cart that includes a handle and shelves for supporting equipment.

The self-contained system includes a pump mounted on the cart for supplying cleaning fluid as well as a power system and controls. The pump is connected to a cleaning fluid supply reservoir also carried on the cart and an expansion tank acting as an accumulator. The controller and control valve arrangement allow for operating the system at desired flows and pressures. The pump is connected to an extended length of hose and a spray wand providing the desired spray pattern for cleaning the coils. The portable system of the present invention provides flow and spray that duplicates a conventional hand-held pump sprayer used in cleaning cooling coils.

The self-contained portable system also includes its own power supply, preferably a long life 12 volt marine type battery and a charger. A power cord may also be included to connect to an outlet and tap into a building's power supply. A power inverter may also be utilized and provide an outlet for recharging other equipment for maintenance or portable tools that may be utilized in the cleaning operations. The portable tools may be carried on the cart shelves.

The portable self-contained system includes all power, cleaning and controls to deliver the cleaning fluids at the required pressure from a convenient location. The portability of the self-contained system is enhanced by its ability to be moved by a single worker and pass through standard door frames. The system also provides provisions for extended operations that are not possible with systems of the prior art.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT(S)

Figure 1:
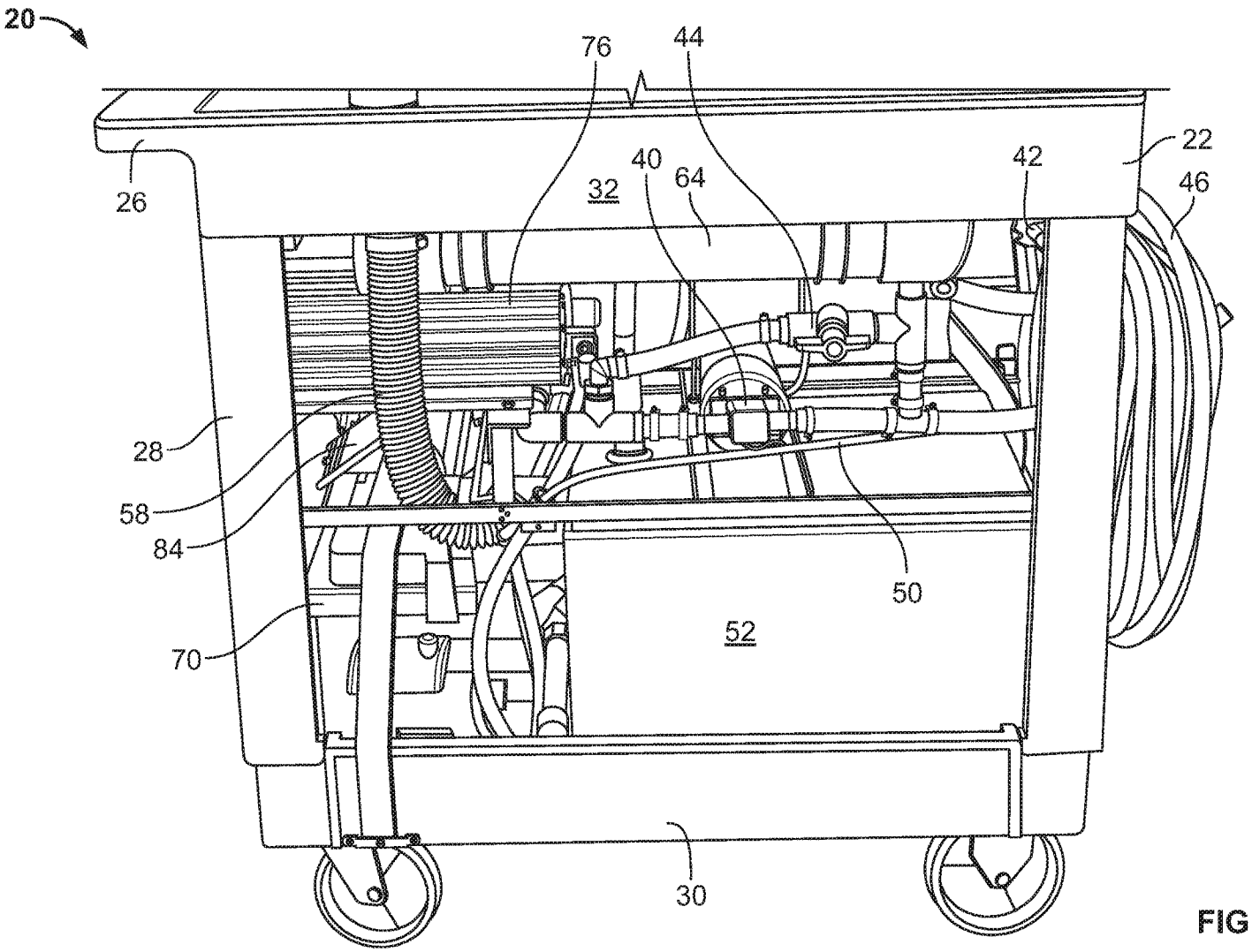
FIG. 1 is a right side elevational view of a portable self-contained cooling coil cleaning system according to the principles of the present invention.

Referring now to the drawings and in particular to FIGS. 1-4, there is shown a self-contained portable cooling coil cleaning system, generally designated (20). The portable cleaning system (20) is mounted on a cart (22) rolling on four casters or wheels (24). The cart (22) includes a supporting frame (28) with a bottom shelf (30) and a top shelf (32) made of a lightweight molded in the embodiment shown. It is also envisioned that depending upon the specific needs and application, additional shelves may be utilized. In the embodiment shown, components of the system (20) are generally supported on the bottom shelf (30) while the top shelf (32) provides storage of tools and other equipment and supplies. An integral handle (26) allows for easy manual transport and steering of the cart (22). The cart (22) should be sufficiently large to hold all necessary equipment but also be sized to be easily moved by a single worker and should be able to fit through standard door openings. A 2 Shelf Plastic Utility Cart, Model Number WB241749 from Global® Equipment of Port Washington, N.Y. having a length of 34 inches, a height of 33 inches and a width of 17 inches has been found to provide satisfactory capacity and storage while still achieving sufficient mobility and access. Such a cart has the shelves (30) and (32) configured as 2.5 inch deep trays. The shown embodiment includes four 5 inch diameter rubber casters (24) providing vibration isolation and damping with two of the casters (24) being swivel mounted to aid in steering the cart (22).

Figure 6:
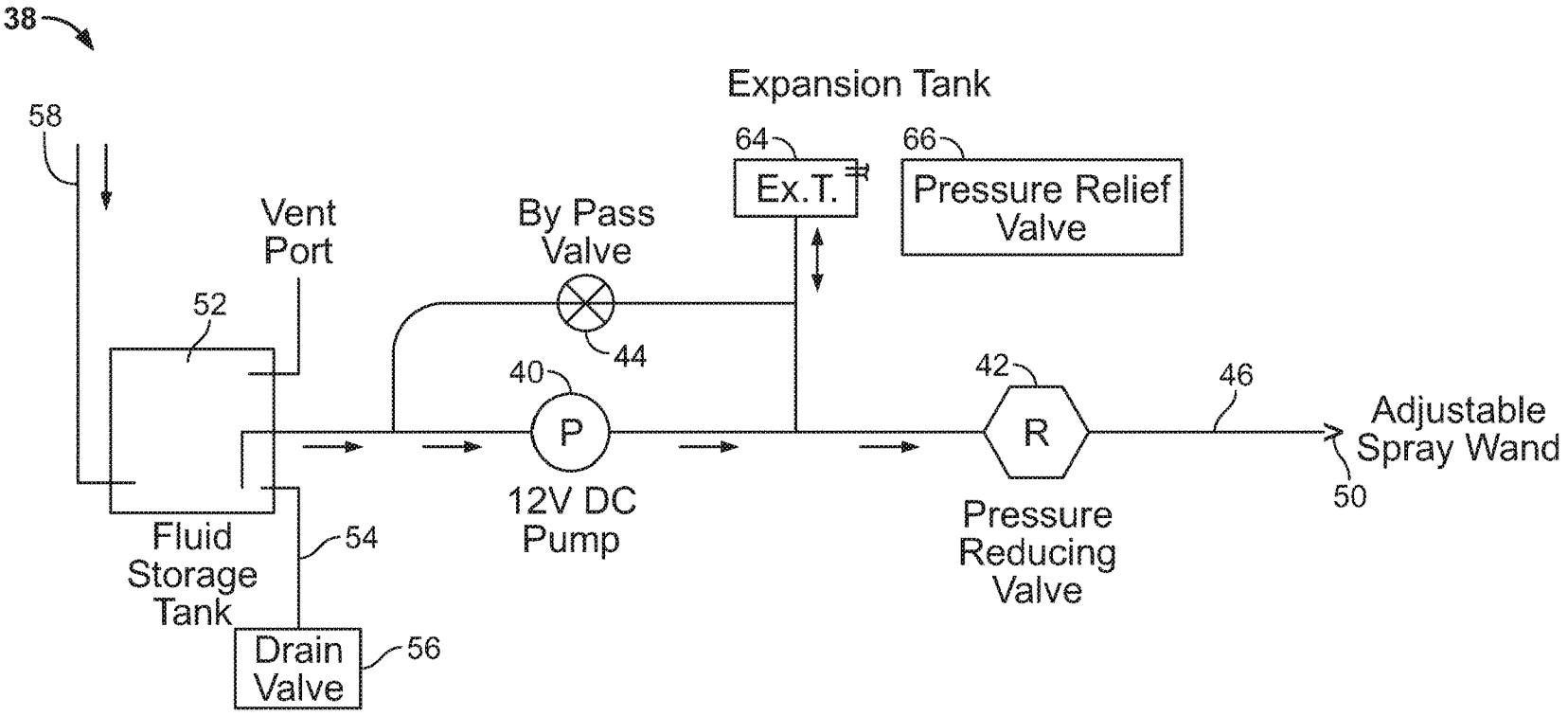
FIG. 6 is a fluid flow chart for the portable self-contained cooling coil cleaning system shown in FIG. 1.

Referring now to FIG. 6, the self-contained portable cooling coil cleaning system (20) includes a cleaning fluid supply system (38) with a pump (40) and an adjustable flow regulator (42). The pump (40) may be a 12 volt DC marine grade pump. A suitable pump has been found to be a Flojet® Duplex Diaphragm Design 2100 Series pump. The self-contained portable coil cleaning system (20) also includes a cleaning fluid supply in a reservoir (52). The flow regulator valve (42) is adjustable to maintain a predetermined fluid pressure as a lower pressure is typically utilized for delicate cooling coils than high pressures used for other spray systems. The self-contained portable system (20) achieves cleaning fluid flow and a spray pattern that duplicates conventional hand-held pump sprayers used for cleaning cooling coils. It can be further be appreciated that the larger cart (22) with four wheels or casters (24) with a large load capacity supports a larger reservoir (52) for the cleaning fluid than is possible with prior dolly mounted systems while still allowing access to remote locations. In the embodiment shown, a large 9 gallon reservoir (52) is provided. The large capacity adds flexibility and efficiency as more cleaning may be conducted without having to leave the site of the cooling coils to refill fluids. Moreover, the top shelf (32) may hold additional containers of cleaning fluid that may be poured into the reservoir (52) through a fill line (58). The top of the fill line (58) extends above the top shelf (32) for easy access and includes a cap (60). A drain (54) and drain valve (56) allow for emptying the reservoir (52) of fluid when finished.

The cleaning fluid supply system (38) includes all necessary plumbing lines and has a bypass valve (44) leading to an expansion tank (64) and relief valve (66) to provide over pressure relief. The bypass line and valve (44) are arranged in parallel with the pump (40) and prevent damage should problems such as clogging or a pressure build up occur with the fluid supply system (38). The expansion tank (64) and pressure relief valve (66) maintain fluid pressure in the cleaning fluid supply system (38) of the cooling coil cleaning system (20).

Figure 2:
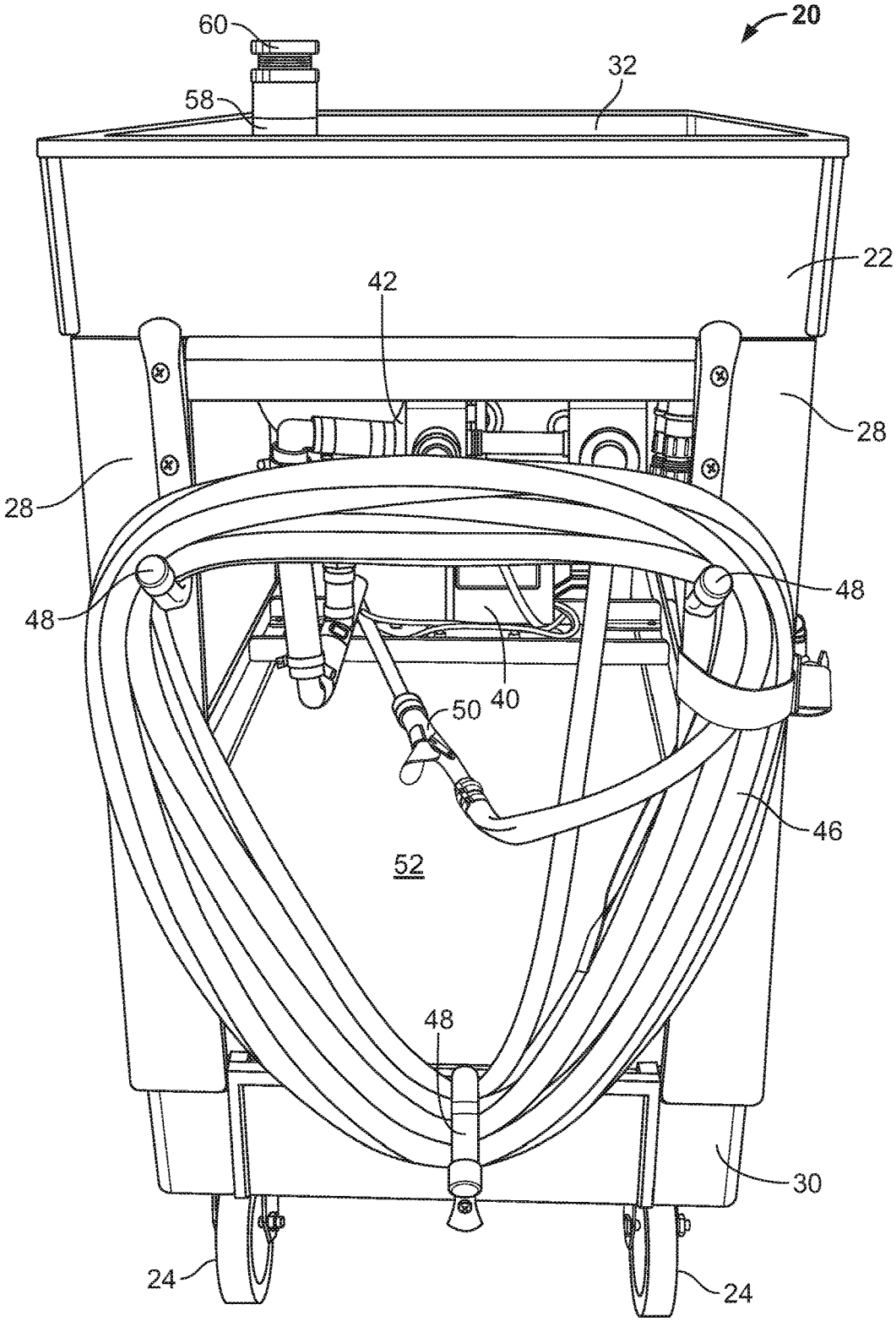
FIG. 2 is a front elevational view the portable self-contained cooling coil cleaning system shown in FIG. 1.
Figure 3:
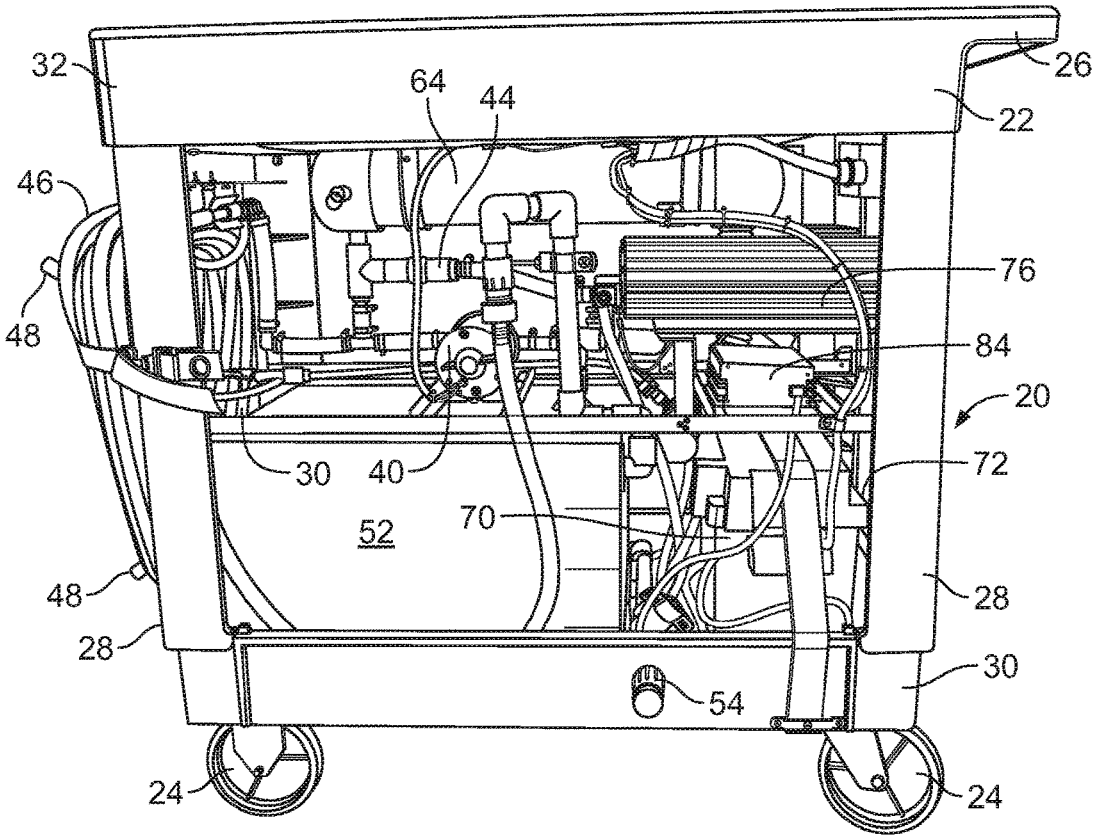
FIG. 3 is a left side elevational view of a portable self-contained cooling coil cleaning system according to the principles of the present invention.

A hand-held adjustable spray wand (50) with an extended length of hose (46) connects to the pump (40). Different types of wands may be interchangeably connected to the hose (46) when needed for different applications. As shown in FIG. 2, hangers (48) store the hose (46) in a coiled arrangement to prevent tangling and/or kinking.

Figure 7:
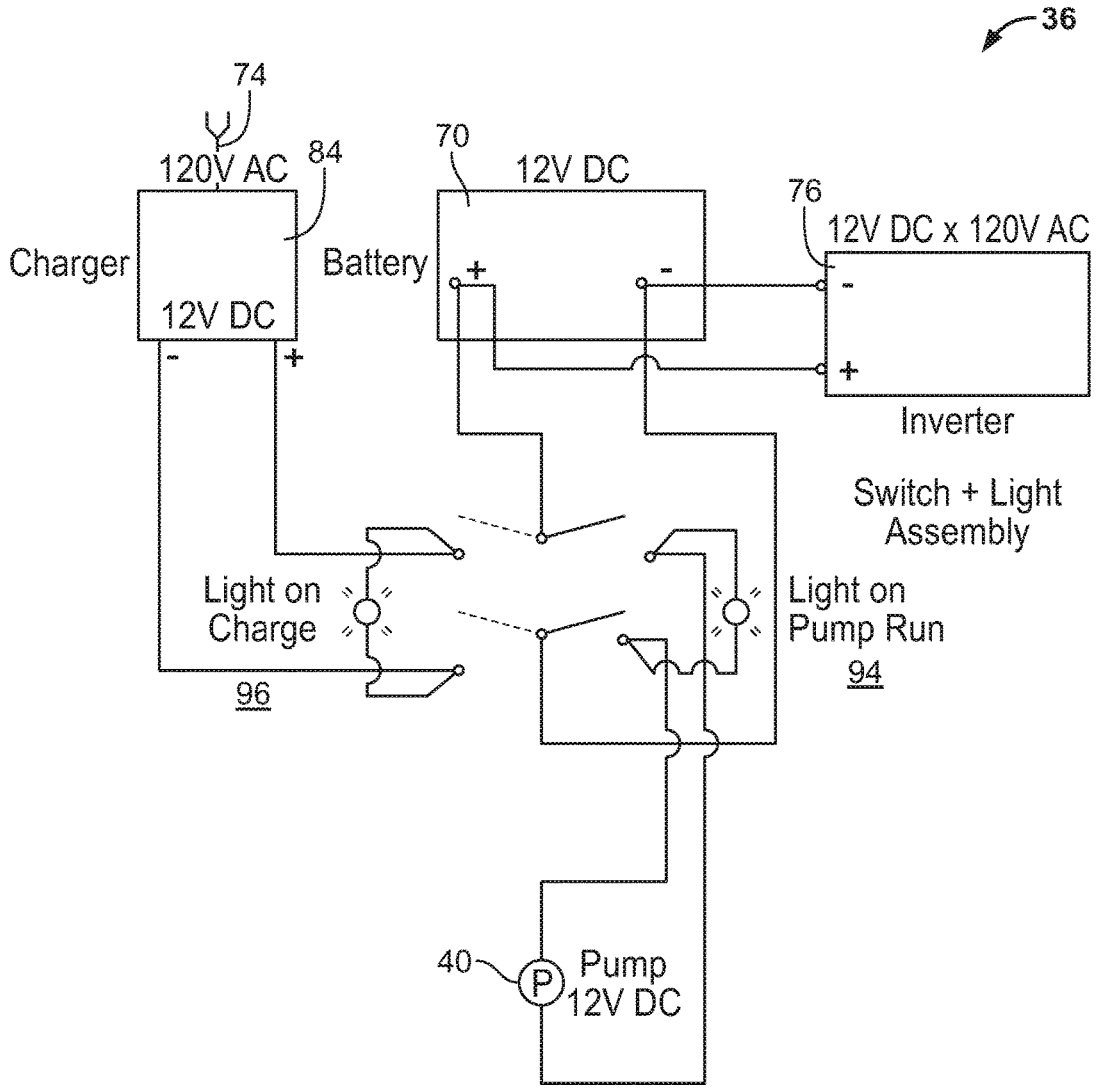
FIG. 7 is an electrical schematic for the portable self-contained cooling coil cleaning system shown in FIG. 1.

Referring now to FIG. 7, the electrical system (36) of the self-contained portable cooling coil cleaning system (20) is shown. The electrical system (36) includes its own power supply including a battery (70) and protective housing (72). The battery (70) is preferably a 12 volt long life marine grade battery that provides power to the pump (40) for up to several days from a full charge under normal operating conditions. Moreover, the battery (70) has a charger (82) with a power cord (74) to access AC outlets and provide for charging the battery (70). In this manner, the portable cleaning system (20) may be operated for extended periods of time without having to leave and recharge the battery or replace a dead battery with a charged battery (70). A power inverter (76) is also provided and connected to the battery (70). The power inverter (76) allows for utilizing the 12 volt DC power from the battery (70) of the portable self-contained cooling coil cleaning system (20) and inverting the direct current to 120 volt alternating current for other uses. The power inverter (76) provides outlets (78) to deliver power for hand hold power tools (100) or to charge cordless tool batteries or other portable equipment used in cleaning and other tasks performed in conjunction with coil cleaning. The power inverter (76) also includes an on/off switch (80) and an AC power connect terminal (82). The power inverter (76) may have an integrated charger or the electrical system may include a separate charger (84) for using 120 volt AC current from the building to recharge the battery (70) between uses. In the event that the pump (40) must be operated, but the battery (70) is dead, the charger (84) includes a bypass switch (86) so that the charger (84) may be plugged into the building power to run the pump (40).

Figure 4:
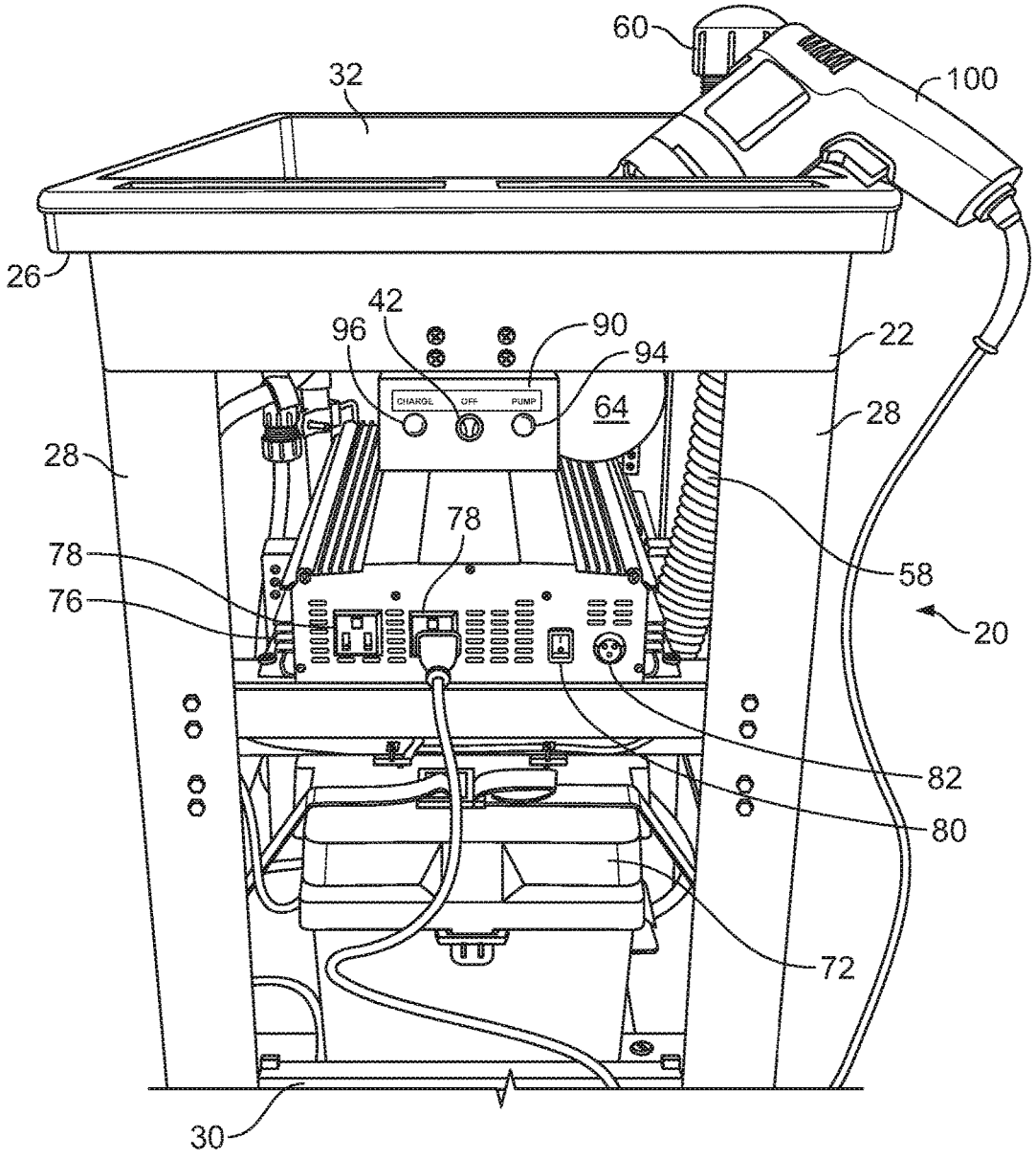
FIG. 4 is a rear elevational view the portable self-contained cooling coil cleaning system shown in FIG. 1.
Figure 5:
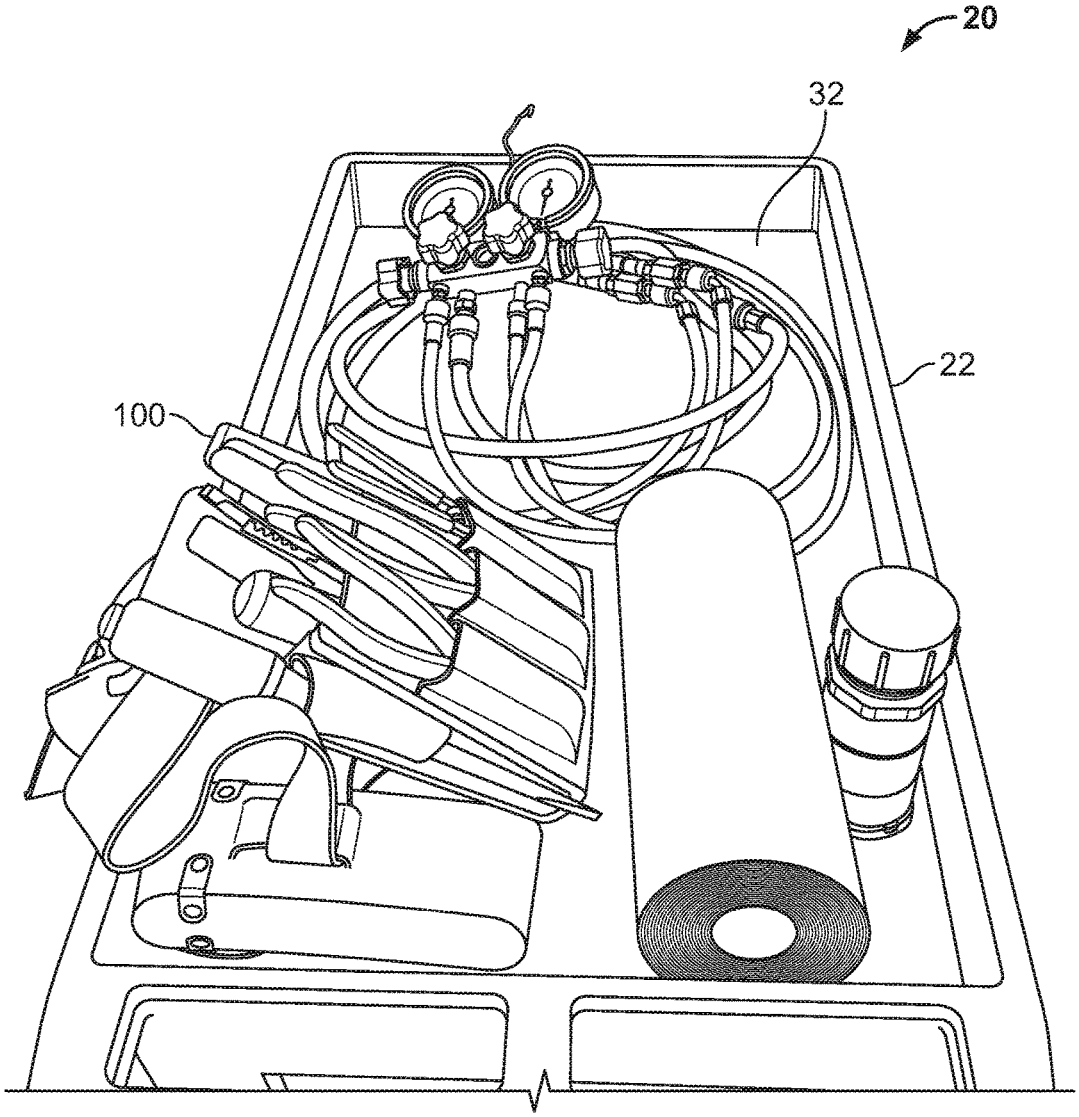
FIG. 5 is a top perspective view of the portable self-contained cooling coil cleaning system shown in FIG. 1 with tools and equipment stored thereon.

Referring to FIG. 4, the self-contained portable cooling coil cleaning system (20) includes a control panel (90) mounted at the rear of the cart (22). The control panel (90) includes a control switch (92) including positions for "on", "off" and "charge" for simple operation. The control panel (90) also includes indicators for the pump on/off (94) and for charging (96).

The self-contained portable cooling coil cleaning system (20) has ample storage on the top shelf (32) for transporting hand tools (100), cords (74), lights, additional cleaning fluid and other equipment on the cart. Additional hose (46) may also be stored if required by the particular task or application.

In operation, the self-contained system (20) is prepared for use by loading all necessary equipment and supplies onto the cart (22). The power supply (70) is fully charged and the cleaning fluid reservoir (52) is filled with cleaning fluid. Moreover, hand tools and sufficient hose are placed on the cart for use. Other equipment used for cleaning or related tasks may also be transported on the cart (22). When loaded, a worker pushes the self-contained cleaning system (20) with all required elements transported on the cart (22). The cart (22) is positioned at a location so that there is sufficient hose (46) to reach the cooling coils with the nozzle or wand (50). The cart (22) may also be positioned so that a power cord (74) may be connected to the building AC power supply. With the cart (22) transporting a sufficient length of hose (46) and power cord (74) as well as a large supply of cleaning fluid, the cart (22) may remain for extended periods for cleaning at a position near cooling coil installations and/or moved to other cooling coil installations without having to return for charging or refilling as is required for prior cleaning systems. The cart (22) provides ample capacity and yet is sufficiently compact and maneuverable to access even remote and difficult to reach cleaning coil installations. Moreover, the self-contained system (22) provides further utility as other cleaning and maintenance equipment may be connected to the outlets (78) of the power inverter (76) so the self-contained cooling coil cleaning system (20) acts as a portable power source for other equipment. It can further be appreciated that when all cleaning and related operations are complete, all hose, cords and portable tools may be reloaded and transported on the cart (22).

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A portable self-contained cooling coil cleaning system, comprising:

a cart having a frame, a top shelf and a bottom shelf, the top shelf forming a rectangular storage tray with a continuous tray bottom and four sides extending upward from edges of the tray bottom and defining a storage space; and the bottom shelf forming a rectangular storage tray with sides, an open intermediate space between the top shelf and the bottom shelf with open sides and ends;

at least four wheels supporting the cart;

a hose;

a spray wand at an extended end of the hose;

the system further comprising within the open intermediate space above the bottom shelf and below the top shelf:

a battery;

an adjustable flow regulator configured to maintain fluid pressure through the spray wand;

a cleaning fluid reservoir on the bottom shelf;

a bypass line and a bypass valve leading to an expansion tank;

a pressure relief valve, on the cleaning fluid reservoir, controlling flow through the bypass line leading from the cleaning fluid reservoir to the expansion tank, to provide over pressure relief, the bypass line and the bypass valve are arranged in parallel with a pump;

and the pump driven by the battery, the pump being in fluid communication with the cleaning fluid reservoir and delivering cleaning fluid to the hose;

a charger for charging the battery;

a power inverter connected to the battery, the power inverter utilizing direct current from the battery and inverting the direct current to 120-volt alternating current;

the power inverter includes an on/off switch and an AC power connect terminal;

the power inverter including a power outlet;

the charger includes a bypass switch so that the charger may be plugged into a building power;

a control panel includes a control switch including an on position, an off position and a charge position, and indicators for indicating an on or off condition of the pump and a charging condition of the battery;

a fluid fill line extending from above the sides of the storage tray of the top shelf through the top shelf and to the cleaning fluid reservoir.

2. A portable self-contained cooling coil cleaning system according to claim 1, further comprising at least one power tool stored in the storage tray of the top shelf.

3. A portable self-contained cooling coil cleaning system according to claim 1, further comprising a hose hanger for storing the hose in a coiled configuration.

4. A portable self-contained cooling coil cleaning system according to claim 1, further comprising at least one portable power tool, wherein the power outlet is configured for connecting to the at least one portable power tool.

5. A portable self-contained cooling coil cleaning system according to claim 1, wherein a top of the fill line extends above the top shelf and the top of the fill line includes a cap.

6. A portable self-contained cooling coil cleaning system according to claim 1, wherein the top shelf storage tray defines a tool storage space.

7. A portable self-contained cooling coil cleaning system, comprising:

a cart having a frame, an upper shelf and a bottom shelf, the upper shelf forming a rectangular storage tray with sides and the bottom shelf forming a rectangular storage tray with sides, an open intermediate space between the top shelf and the bottom shelf with open sides and ends;

at least four wheels supporting the cart;

a hose;

hangers for storing the hose in a coiled configuration;

a spray wand at an extended end of the hose;

the system further comprising within the open intermediate space above the bottom shelf and below the top shelf:

a battery;

an adjustable flow regulator configured to maintain fluid pressure through the spray wand;

a cleaning fluid reservoir on the bottom shelf;

a bypass line and a bypass valve leading to an expansion tank;

a pressure relief valve, on the cleaning fluid reservoir, controlling flow through the bypass line leading from the cleaning fluid reservoir to the expansion tank, to provide over pressure relief, the bypass line and the bypass valve are arranged in parallel with a pump;

the pump driven by the battery, the pump being in fluid communication with the cleaning fluid reservoir and delivering cleaning fluid to the hose;

a power inverter connected to the battery;

the upper shelf including:

a tray for storing equipment, the tray including a flat continuous bottom and four sides extending upward from the bottom and defining an upper storage space; and a charger for charging the battery and a bypass switch connecting the charger to the pump, a power inverter connected to the battery, the power inverter inverting direct current to 120-volt alternating current (AC); the power inverter includes an on/off switch, an AC power connect terminal, and a power outlet;

the charger includes a bypass switch so that the charger may be plugged into a building power;

a control panel includes a control switch including an on position, an off position, and a charge position, and indicators for indicating an on or off condition of the pump and a charging condition of the battery;

a fluid fill line leading to the cleaning fluid reservoir, wherein a top of the fluid fill line extends above the top shelf and the top of the fluid fill line includes a cap.

8. A portable self-contained cooling coil cleaning system according to claim 7, wherein the upper shelf storage tray defines a tool storage space.

* * * * *